US005253364A

United States Patent [19]

Robinson

[11] Patent Number: 5,253,364

[45] Date of Patent: Oct. 19, 1993

[54] BASEBALL-STYLE CAP HAVING A ROTATABLE BILL

[76] Inventor: Case J. Robinson, 420 S. Third St., Apt. 34, San Jose, Calif. 95112

[21] Appl. No.: 918,206

[22] Filed: Jul. 20, 1992

[51] Int. Cl.[5] ..... A61F 9/00

[52] U.S. Cl. ..... 2/10; 2/209.12; 2/195.1

[58] Field of Search ..... 2/10, 12, 15, 171, 177, 2/178, 185 R, 186, 195, 196, 199, 209.1

[56] References Cited

U.S. PATENT DOCUMENTS

| | | | |
|---|---|---|---|
| 1,648,551 | 11/1927 | Klein | 2/195 |
| 1,677,187 | 7/1928 | Leibson | 2/177 |
| 4,777,667 | 10/1988 | Patterson et al. | 2/199 |
| 4,821,341 | 4/1989 | Baptiste | 2/199 |
| 5,070,545 | 12/1991 | Tapia | 2/10 |
| 5,091,995 | 3/1992 | Oates | 2/10 |

FOREIGN PATENT DOCUMENTS

| | | | |
|---|---|---|---|
| 2317580 | 10/1974 | Fed. Rep. of Germany | 2/10 |
| 1096543 | 6/1955 | France | 2/10 |
| 2240029 | 7/1991 | United Kingdom | 2/195 |

*Primary Examiner*—Clifford D. Crowder
*Assistant Examiner*—Diana L. Biefeld
*Attorney, Agent, or Firm*—Schneck & McHugh

[57] ABSTRACT

A baseball-style cap includes a crown portion and a bill that is rotatable about a generally horizontal rotational axis. The bill projects outwardly from the crown portion, but is repositionable along the outer periphery of the crown portion from a forward eye-shading position to a rearwardly directed neck-shading position. Resilient members fix the bill to the crown portion and provide a force that maintains the bill in a desired position. Fastening members can be used to maintain the bill in traditional eye-shading position.

13 Claims, 1 Drawing Sheet

BASEBALL-STYLE CAP HAVING A ROTATABLE BILL

TECHNICAL FIELD

The present invention relates generally to garments and more particularly to baseball-style caps.

BACKGROUND ART

The function of a baseball-style cap, i.e. a hat having an outwardly projecting bill at only one side of the hat, has been appreciated for many years. A baseball-style cap reduces eye glare and protects the wearer's face, and particularly the wearer's nose, from the damaging effects of prolonged exposure to the sun. If the wearer is an observer of a sporting event rather than a participant, depending upon the direction of the sun the cap can be turned around to protect the person's neck.

While the function has been fully appreciated, the fashionability of the baseball-style cap has not. Only recently has it become fashionable to wear baseball-style caps. Hats worn by players of teams which are no longer in existence are again being manufactured, e.g., Boston Braves. Moreover, it has become stylish to rotate the cap so that the bill is pointed in a direction other than that faced by the wearer. Typically, the rotation of the cap is 180°, so that the bill faces rearwardly. However, it follows that any emblem on the cap would then also face rearwardly.

It is an object of the present invention to provide a baseball-style cap that enhances both the functionality and the fashionability of the cap.

SUMMARY OF THE INVENTION

The above object has been met by a baseball-style cap that allows a wearer to select the direction in which a bill is to point and to independently select the direction in which any emblem on the cap is to face. The bill extends outwardly from a crown portion of the cap and is repositionable along the outer periphery of the crown portion to permit selection of the angle of the bill relative to the horizontal.

Resilient fastening members are utilized to fasten the bill to opposed lateral sides of the crown portion. The fastening members are placed in tension, so that an inner edge of the bill is urged against the crown portion. This provides a force for maintaining the bill in a selected orientation relative to the crown portion. The resilient fastening members may be springs, elastic members, or any other devices which pull the bill against the crown portion.

Traditionally, the bill and any cap emblem of a baseball-style cap face in the same direction. The present invention includes fasteners that lock the bill in a forward-facing position. For example, the crown portion and the bill may include snaps to lock the bill in the traditional position. The use of hook-and-loop fasteners is also possible. However, the bill may be pulled away from the crown portion and relocated in a less traditional position. The choice of the less traditional position may be dictated by fashion, but may also be dictated by the desire to protect the wearer's neck from prolonged exposure to the sun. In either case, the option remains to allow the cap emblem to face forwardly.

An advantage of the present invention is that it allows a wearer a greater freedom of choice with respect to wearing the cap. The bill can be faced forwardly, rearwardly or in any direction therebetween. Another advantage is that it provides another feature of a baseball-style cap that can be configured to show identification of the wearer with a particular athletic team. For example, a fan of the San Jose Sharks professional hockey team may have a bill in the shape of a shark fin, allowing the wearer to rotate the bill 90° relative to the horizontal and rotate the crown portion 90° relative to the vertical whenever the hockey team is in the power play situation. The simultaneous 90° rotations align the bill with the direction of the wearer, simulating a shark attack.

BEST MODE FOR CARRYING OUT THE INVENTION

Figure 1:
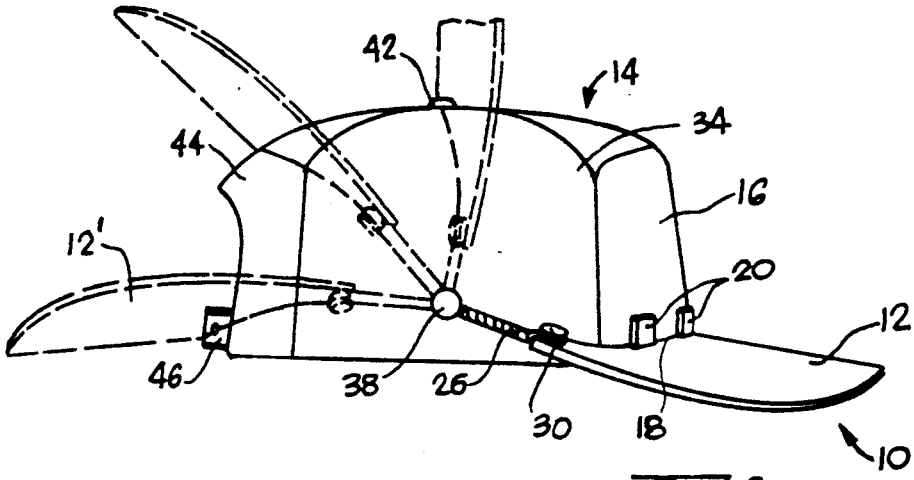
FIG. 1 is a side view of a baseball-style cap having a bill locked in a forwardly directed position, with other positions shown in phantom in accordance with the present invention.

With reference to FIG. 1, a baseball-style cap 10 includes a bill 12 attached to a crown portion 14. The bill extends outwardly from a forward side 16 of the crown portion. An inner edge 18 of the bill is locked in place relative to the forward side 16 by fastening members 20.

Figure 2:
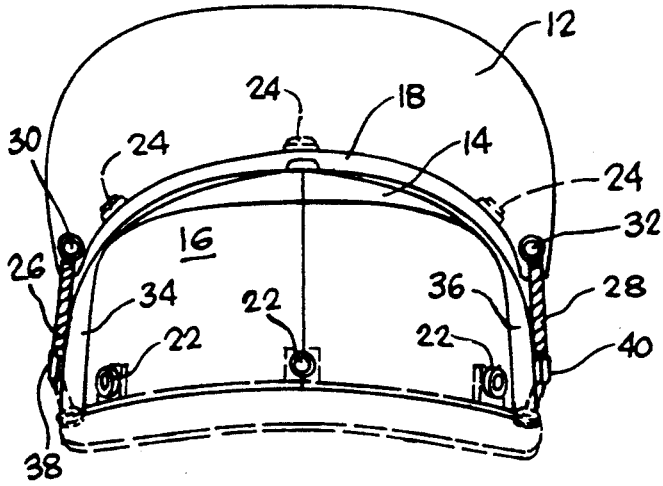
FIG. 2 is a front view of the baseball-style cap of FIG. 1 with the bill in an upwardly directed position.

The fastening members 20 may be of any type which allows release of the bill 12 from the position illustrated in solid lines. For example, the fastening members may comprise loop material attached to the forward side 16 of the crown portion 14 and hook material fixed to the bill 12. In FIG. 2, the fastening members are shown as including first snap members 22 on the crown portion 14 and second snap members 24 on the bill. When the second snap members are pressed into engagement with the first snap members, the bill 12 is locked into an eye-shading position shown in solid in FIG. 1 and shown in phantom in FIG. 2.

A pair of resilient members 26 and 28 are affixed by attachments 30 and 32 to the bill 12. The opposite end of each resilient member is secured to a lateral side 34 and 36 of the crown portion 14 by a button 38 and 40. The attachments 30 and 32 and the buttons 38 and 40 may be plastic or metal members that allow end loops of the resilient members 26 and 28 to be secured to the attachments. The resilient members may be coil springs or may be elastic cords, but this is not critical. What is important is that the resilient members remain in tension to urge the inner edge 18 of the bill 12 against the crown portion 14.

In FIG. 2, the inner edge 18 is shown as being spaced apart from the crown portion 14, but when the resilient members 26 and 28 are allowed to relax, the inner edge is forced onto the outer periphery of the crown portion. The force maintains the bill in any desired position along the outer periphery of the crown portion. Three alternative positions are shown in phantom in FIG. 1.

Typically, if a baseball-style cap 10 includes a logo or some other cap emblem, it will be secured to the forward side 16 of the crown portion 14. Should a wearer decide to locate the bill 12 of the cap at the person's neck, the entire cap can be rotated 180°. However, this places the cap emblem in a rearwardly facing direction.

The baseball-style cap 10 of FIG. 1 allows a wearer to independently decide the directions faced by the bill 12 and any cap emblem. Detachment of the fastening members 20 and application of a force to overcome the tension of the resilient members 26 and 28 permits the bill 12 to rotate about an axis defined by the buttons 38 and 40. The bill can be released to secure the bill in any position along its arc of travel, but fashion and function will in most cases provide a situation in which the bill is either in the eye-shading position shown in solid in FIG. 1, or the neck-shading position 12' shown in phantom in the same figure.

With the exception of attachment of the bill 12 to the crown portion 14, the baseball-style cap is known in the art. At the top of the crown portion is a traditionally placed button 42. The bottom of the crown portion is referred to as a rim. At the rearward side 44 of the crown portion is an adjustable device 46 that permits the cap to be adjusted to any of a variety of hat sizes. The adjustable device is not critical to the present invention, and in fact a baseball-style cap of the type that is designed to fit only wearers having a particular hat size may be more comfortable in use with the rotating bill 12. The adjustable device 46 may comprise first and second plastic straps, with the first strap having a series of equally spaced holes and the second strap having a series of equally spaced pegs adapted to snugly fit within the holes of the first strap.

Figure 3:
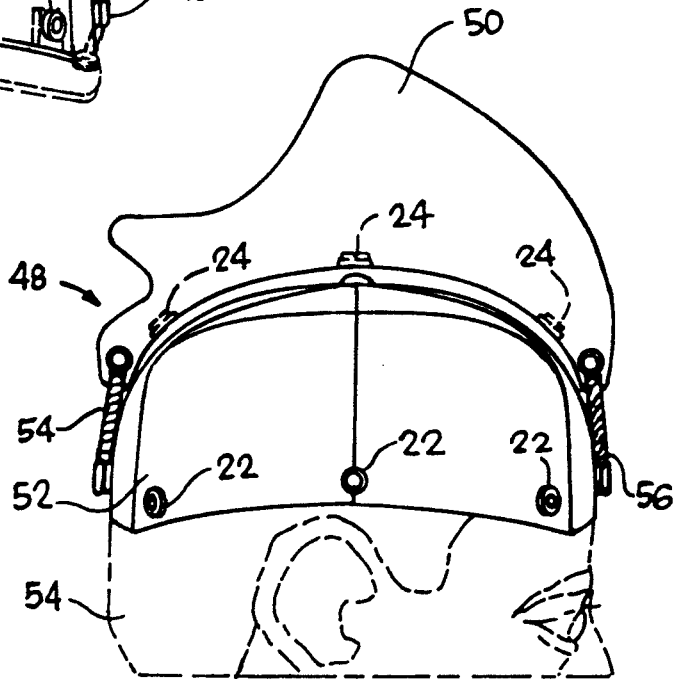
FIG. 3 is a side view of a second embodiment of the baseball-style cap of FIG. 2.

The ability to rotate the bill 12 of a baseball-style cap 10 in the manner shown in FIG. 1 allows an increased stylization of the bill. Referring now to FIG. 3, a baseball-style cap 48 may have a bill 50 that is configured to resemble a shark fin or another body part of an animal that is the nickname of an athletic team. The bill 50 in the shape of a shark fin may be used by fans of the professional hockey team San Jose Sharks, for example. By rotating the cap 90° relative to the vertical, so that a forward side 52 faces sideways relative to the head 54 of a user, and by rotating the bill 50 90° relative to the horizontal, the bill will best simulate a shark on attack.

The baseball-style hat 48 of FIG. 3 includes first and second snap members 22 and 24 described above for locking the bill 50 in a traditional eye-shading position. The tension of resilient members 54 and 56 at opposed sides of the cap 48 provides a means for maintaining the bill in any other desired position, such as the one illustrated in FIG. 3.

I claim:

1. A baseball-style cap comprising, a crown portion to fit an individual's head, the crown portion having an outer periphery and a lower rim, the crown portion having forward and rearward sides, a bill extending outwardly from the crown portion, the bill having an inner edge in contact with the outer periphery of the crown portion and having an eye-shading position in which the inner edge is adjacent to the lower rim at the forward side of the crown portion, the bill being generally horizontal when in the eye-shading position, locking means for releasably fixing the bill in the eye-shading position, release of the locking means permitting movement of the bill from said eye-shading position, fastening means for resiliently coupling the inner edge of the bill to the crown portion such that the bill is secured to the crown portion while allowing rotation of the bill about a generally horizontal axis, the resilient coupling having a radially inwardly directed force to securely fix the inner edge of the bill at any position along the outer periphery of the crown portion, thereby permitting selection of the angle of the bill relative to the horizontal from the eye-shading position to a neck-shading position.

2. The cap of claim 1 wherein the fastening means includes first and second resilient members, each resilient member having a first end fixed to the crown portion and having a second end fixed to the bill, the resilient members disposed to exert a force urging the inner edge of the bill against the crown portion, the bill thereby having a tendency to remain in a fixed position relative to the crown portion.

3. The cap of claim 2 wherein the resilient members are elastomeric members.

4. The cap of claim 2 wherein the resilient members are springs.

5. The cap of claim 1 wherein the locking means is a plurality of snaps.

6. The cap of claim 1 wherein the bill has a neck-shading position in which the inner edge of the bill is adjacent to the lower rim at the rearward side of the crown portion, the fastening means connected to provide a full range of motion of the bill between the eye-shading and the neck-shading positions.

7. A baseball-style cap comprising, a crown portion having forward, rearward and opposed first and second lateral sides, a bill having a first edge adjacent to the crown portion, the bill extending outwardly from the first edge to a second edge, resilient means attached to the first and second lateral sides of the crown portion and to the bill for urging the first edge of the bill against the crown portion, the resilient means allowing rotation of said bill about a generally horizontal axis, thereby providing movement of the bill relative to the crown portion from a forwardly directed position at the forward side to a rearwardly directed position at the rearward side, the resilient means having a force to fix the bill in any position intermediate of the forwardly directed position and the rearwardly directed position, and fastening means for releasably locking the bill in the forwardly directed position.

8. The cap of claim 7 wherein the resilient means includes first and second springs, each having a fixed end attached to the bill and having a rotatable end coupled to one of the lateral sides of the crown portion.

9. The cap of claim 7 wherein the resilient means includes first and second elastic members having first ends fixed to the bill and second ends coupled to the lateral sides of the crown portion.

10. The cap of claim 7 wherein the fastening means includes snaps having first members attached to the bill and second members attached to the forward side of the crown portion.

11. The cap of claim 7 wherein the resilient means fixes the bill to the crown portion to provide a range of rotation exceeding 180° with respect to movement of the bill relative to the crown portion.

12. The cap of claim 7 wherein the bill has an asymmetrical configuration resembling a body part of an animal.

13. The cap of claim 12 wherein the bill has a shape of a shark fin.

* * * * *